US008069500B2

(12) United States Patent
Seskin et al.

(10) Patent No.: US 8,069,500 B2
(45) Date of Patent: Dec. 6, 2011

(54) URINAL APPARATUS INCLUDING A SIMULATED GOLF CLUB

(76) Inventors: Floyd E. Seskin, North Miami Beach, FL (US); Ben Junior Bush, Pembroke Pines, FL (US); Gary A. Crain, Cooper City, FL (US)

( * ) Notice: Subject to any disclaimer, the term of this patent is extended or adjusted under 35 U.S.C. 154(b) by 1323 days.

(21) Appl. No.: 11/633,944

(22) Filed: Dec. 5, 2006

(65) Prior Publication Data

US 2008/0127402 A1 Jun. 5, 2008

(51) Int. Cl.
*A47K 11/00* (2006.01)

(52) U.S. Cl. ..... 4/144.1

(58) Field of Classification Search ..... 4/144.1; 206/457; 220/4.21, DIG. 13; 215/306; 446/76; D7/515

See application file for complete search history.

(56) References Cited

U.S. PATENT DOCUMENTS

| | | | | |
|---|---|---|---|---|
| 194,454 | A * | 8/1877 | Michaels | 220/4.21 |
| 2,639,804 | A * | 5/1953 | Merahn | 206/457 X |
| 3,938,570 | A * | 2/1976 | Stewart | 206/457 X |
| 2004/0082926 | A1 | 4/2004 | Bruns | |

* cited by examiner

*Primary Examiner* — Lori Baker
(74) *Attorney, Agent, or Firm* — Ronald V. Davidge

(57) ABSTRACT

A portable urinal includes a simulated golf club and a privacy shield, allowing the urinal to be used in a secluded part of a golf course while appearing to practice a golf swing. In one embodiment, the simulated golf club includes an elongated sealed receptacle for holding urine. In another embodiment, the elongated sealed receptacle is formed within a canister attached to the simulated golf club, which may be an actual golf club.

2 Claims, 5 Drawing Sheets

URINAL APPARATUS INCLUDING A SIMULATED GOLF CLUB

BACKGROUND OF THE INVENTION

1. Field of the Invention

This invention relates to a portable urinal, and, more particularly, to a portable urinal including an object simulating a device useful for another purpose, such as a golf club.

2. Summary of the Background Art

A golf course typically includes a large area remote from a restroom, so that a golfer needing to urinate during a round of golf may be particularly uncomfortable and inconvenienced. A need to travel, by walking or golf cart, to a remote bathroom facility in the middle of a round of golf may result in embarrassment while placing a significant restriction on the progress of the golf game. What is needed is a portable urinal that can be used in a secluded part of a golf course without spilling urine and without attracting undue attention.

While U.S. patent application Pub. No. 2004/0082926 A1 describes a portable urinal device to be worn under the clothing of a person expecting to have inadequate access to bathroom facilities, what is needed is a portable urinal device that can be carried within a golf bag and discretely used when needed.

SUMMARY OF THE INVENTION

In accordance with a first aspect of the invention, apparatus is provided, including a simulated golf club, an elongated sealed receptacle, and a removable cap. The simulated golf club, which includes a handle, a shaft, and a head, resembles a golf club and may, in fact, be an actual golf club. The elongated sealed receptacle extends along the simulated golf club downward from an opening at a top of the elongated sealed receptacle, with the opening being sealed by the removable cap.

The elongated sealed receptacle may additionally include screw threads extending around the opening, with the removable cap being attached to the top of the elongated sealed receptacle by screw threads within the cap engaging the screw threads within the elongated sealed receptacle. Alternately, the removable cap may include a stopper extending tightly into the opening at the top of the elongated sealed receptacle to hold the removable cap in place. The apparatus may additionally include a privacy shield adjacent to the opening at the top of the elongated sealed receptacle, with the privacy shield in turn including a cloth attached to the apparatus at a center of the cloth. The elongated sealed receptacle may additionally include a flexible neck below the opening at its top.

The simulated golf club is configured to appear as an additional golf club, which can be carried onto a golf course in a golf bag without attracting undue attention. The apparatus is then used, for example, by a male golfer urinating in a secluded part of a golf course, removing the cap from the sealed receptacle and pretending to practice with the simulated golf club while using the privacy shield to form a personal private area. After the cap is replaced, urine is retained within the sealed receptacle, allowing the apparatus to be carried again as an additional golf club, with the sealed receptacle then being emptied at a convenient time.

In a first embodiment of the invention, the elongated sealed receptacle extends within the handle of the simulated golf club, with the removable cap forming an upper end of the handle of the simulated golf club. The elongated sealed receptacle may additionally extend within the shaft and the head of the simulated golf club. The handle and the head may be removably attached to the shaft.

In a second embodiment of the invention, the elongated sealed receptacle is formed within a canister in a urinal attachment separate from the simulated golf club but attached to the simulated golf club to extend along the simulated golf club, which may be an actual golf club. Such an elongated sealed receptacle may additionally include a first attachment bracket fastening the upper end of the canister to the handle of the simulated golf club and a second attachment bracket fastening the lower end of the canister to the shaft of the simulated golf club. Either or both the attachment brackets may include a hole, through which the canister extends, being latched in place. Alternately, either or both the attachment brackets may include an attachment strap extending around the simulated golf club.

DETAILED DESCRIPTION OF THE INVENTION

Figure 1:
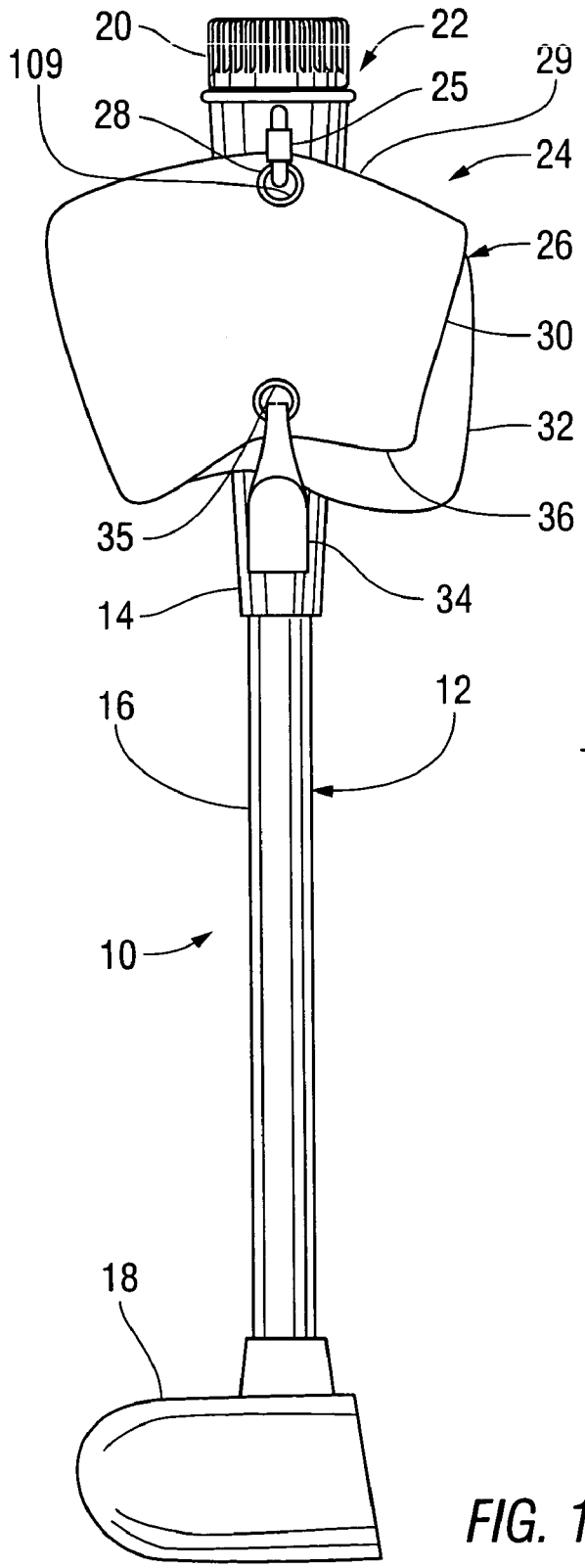
FIG. 1 is a front elevation of urinal apparatus built in accordance with a first embodiment of the invention.

FIG. 1 is a front elevation of urinal apparatus 10 built in accordance with a first embodiment of the invention to include a simulated golf club 12 having a handle 14, a shaft 16, and a head 18. A removable cap 20 seals an opening 22 within the upper end of the handle 14. Preferably, the urinal apparatus 10 additionally includes a privacy shield 24, removably attached to the handle 14 by an attachment device 25 near the opening 22. For example, the privacy shield 24 may include a folded towel 26 having an eyelet 28 attached close to the fold 29, allowing a front portion 30 of the towel 26 to be raised while a rear portion 32 of the towel 26 continues to hang downward, increasing the area in which privacy is achieved using the privacy shield 24. Preferably, the privacy shield 24 additionally includes a hook 34 attached through a second eyelet 35 adjacent a center of the edge 36 of the front portion 30 of the towel 26. The hook 34 may be hooked over the user's belt or trousers to hold the front portion 30 in the raised position. Alternately, a pair of such hooks 34, placed near opposite ends of the edge 36, may be provided.

Figure 2:
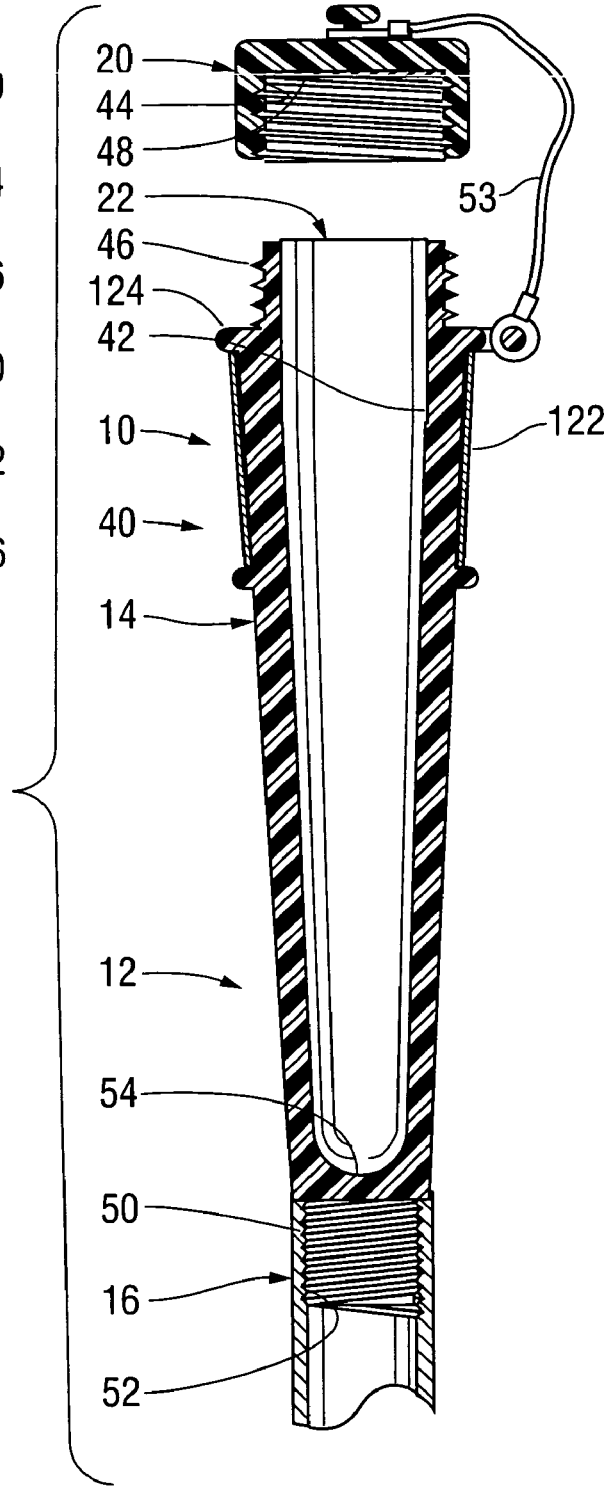
FIG. 2 is a cross-sectional front elevation of an upper portion of a first version of the urinal apparatus of FIG. 1.

FIG. 2 is a cross-sectional front elevation of an upper portion of a first version 40 of the urinal apparatus 10, showing an elongated sealed receptacle 42 extending downward from the opening 22 within the handle 14 of the simulated golf club 12. The removable cap 20, which is shown in an exploded relationship with the handle 14, includes a screw thread 44 engaging a screw thread 46 extending around the opening 22 within the handle 14. The removable cap 20 additionally includes an elastomeric pad 48 sealing the opening 22 when the screw thread 44 of the removable cap 20 is driven into full engagement with the screw thread 46 of the handle 14. For example, the handle 14 is removably attached to the shaft 16 through the engagement of a lower screw thread 50 of the handle 14 with an upper screw thread 52 of the shaft 16. Optionally, the removable cap 20 is attached to the handle 14 by a flexible member 53, such as a cord or chain, in a manner allowing rotation and removal of the cap 20 while preventing its loss.

The urinal apparatus 10 is used, for example, by a man moving into a secluded area within a golf course or other location, removing the cap 20, and pretending to practice his golf swing with the simulated golf club 12 while urinating into the elongated receptacle 42. The privacy shield 24 may be used to form a private space during urination, preferably with the front portion 30 of the towel 26 being held upward using the hook 34 to enlarge the space covered by the towel 26.

As shown in FIG. 2, within the first version 40 of the urinal apparatus 10, the elongated receptacle 42 extends entirely within the handle 14 of the simulated golf club 12, with a lower end 54 of the elongated receptacle 42 being formed as a spherically concave surface to simplify cleaning the receptacle 42. While limiting the elongated receptacle 42 to a space within the handle 14 simplifies the construction, and, more particularly, the cleaning of the apparatus 10, the capacity of the elongated receptacle 42 is limited.

Figure 3:
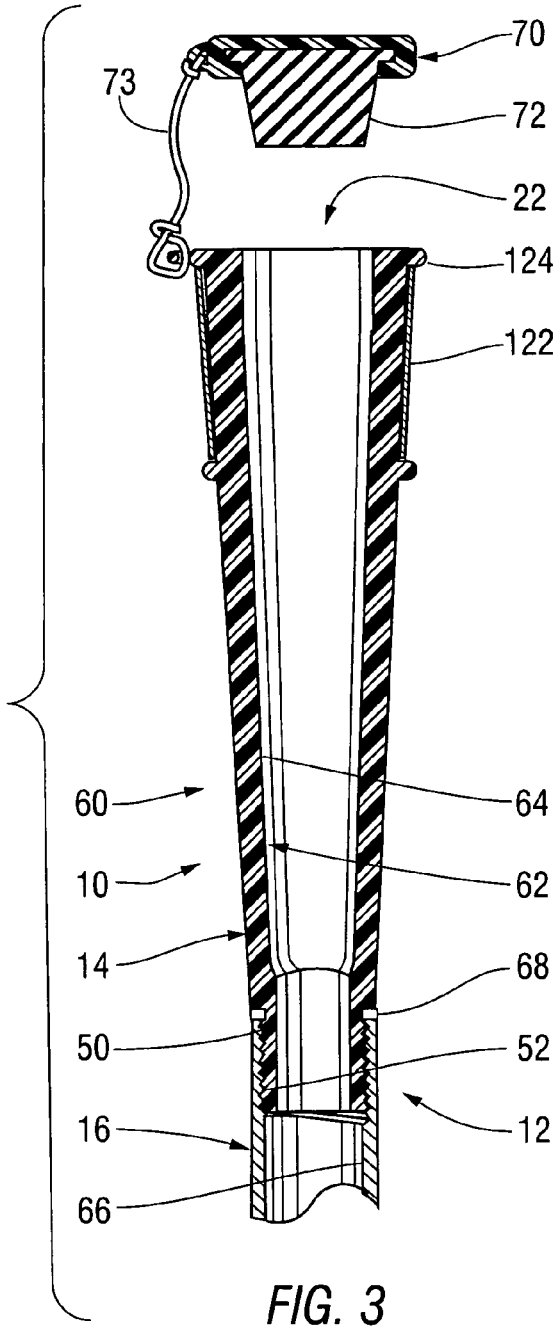
FIG. 3 is a cross-sectional front elevation of an upper portion of a second version of the urinal apparatus of FIG. 1.

FIG. 3 is a cross-sectional front elevation of an upper portion of a second version 60 of the urinal apparatus 10, which is described herein with elements similar to elements of the first version 40 having like reference numbers. The second version 60 includes a simulated golf club 61 provided with an elongated receptacle 62 extending within the shaft 16 as well as within a handle. Thus, the elongated receptacle 62 includes an upper portion 64 within the handle 14 and a lower portion 66 within the hollow shaft 16, with the upper and lower portions 64, 66 being in fluid communication with one another. The handle 63 is removably attached to the shaft 16 with screw threads 50 engaging mating screw threads 52. Preferably, an elastomeric gasket 68 is additionally compressed as the screw threads 50, 52 are fully engaged, with the gasket 68 sealing the space between the screw threads 50, 52.

In the example of FIG. 3, the removable cap 20, described above in reference to FIGS. 1 and 2, is replaced with a removable cap 70 including a stopper 72 fitting tightly within the opening 22 to seal the opening 22 and to hold the removable cap 70 in place. The removable caps 20, 70 can alternately be used in urinal apparatus having either the other features of FIG. 1 or of FIG. 2. Additionally, in the example of FIG. 3, the removable cap 70 is shown as being attached to the handle 63 by means of an optional flexible elongated member 73, which is, for example, a cord or chain, allowing preventing the loss of the cap 70 while allowing its removal from the opening 22.

Figure 4:
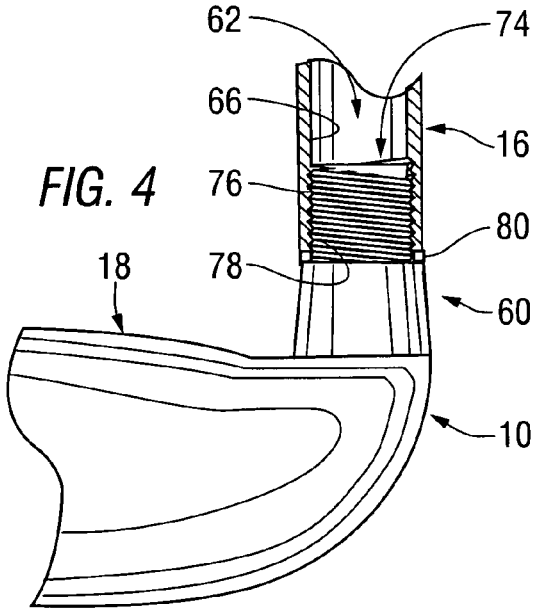
FIG. 4 is a partly sectional side elevation of a lower portion of the second version of the urinal apparatus of FIG. 1.

FIG. 4 is a partly sectional side elevation of a lower portion of the second version 60 of the urinal apparatus 10, showing the lower portion 66 of the elongated receptacle 62 extending within the shaft 16 to a plug 74 forming part of the head 18 of the simulated golf club 61. The plug 74 includes screw threads 76 engaging screw threads 78 within the shaft 16 to removably attach the head 18 to the shaft 16. Preferably, an elastomeric gasket 80 is additionally provided to seal against leakage when the screw threads 76, 78 are fully engaged.

Figure 5:
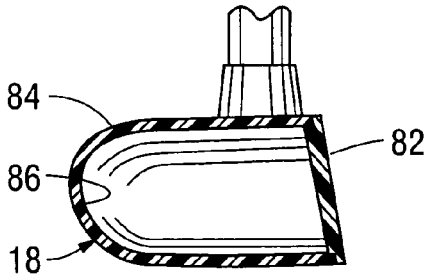
FIG. 5 is a cross-sectional front elevation of a lower portion of the second version of the urinal apparatus of FIG. 1.

FIG. 5 is a cross-sectional front elevation of the lower portion of the second version 60 of the urinal apparatus 10, showing an alternative head 81 as being composed of a plate portion 82 and a main portion 84, which are, for example, adhesively attached to one another after being molded from a thermoplastic resin. Such a configuration allows the formation of a cavity 86 within the main portion 84, facilitating the process of making the head 18 by molding.

In the first version 40 of the urinal apparatus 10, which has been discussed above in reference to FIG. 2, the elongated sealed receptacle 42 is formed entirely within the handle 14, so the gasket 80, not being required to seal between the shaft 16 and the head 18, may be eliminated. Otherwise the lower portion of the first version 40 is as described in reference to FIGS. 4 and 5.

Figure 6:
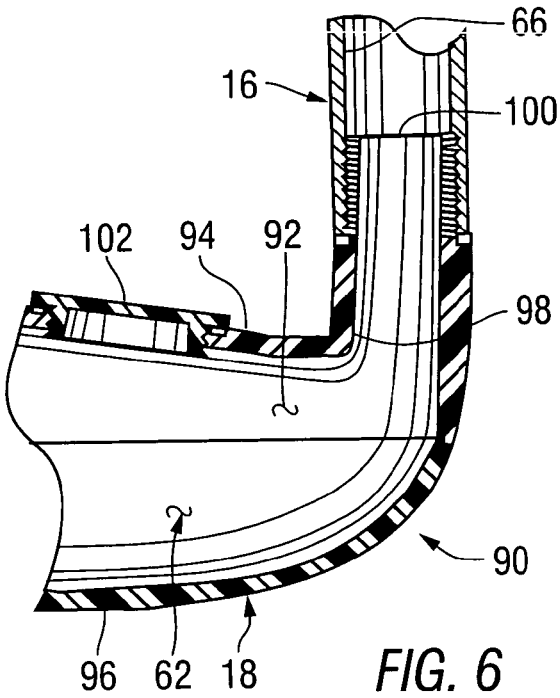
FIG. 6 is a cross-sectional side elevation of a lower portion of a third version of the urinal apparatus of FIG. 1.

FIG. 6 is a cross-sectional side elevation of a lower portion of a third version 90 of the urinal apparatus 10, showing a lowest portion 92 of an elongated sealed receptacle 93 extending within a head 93*a* of a simulated golf club 93*b*. The third version 90 of the-urinal apparatus 10 additionally includes an upper portion as described above in reference to FIG. 3, with the elongated sealed receptacle 93 additionally comprising an upper portion 64 within the handle 14 and a lower portion 66 within the shaft 16. For example, the head 93*a* is formed by adhesively attaching an upper part 94 to a lower part 96, so that a cavity 98 is formed to extend within the head 18 and upward through a hollow plug portion 100 to be in fluid communication with the portion 66 of the elongated sealed receptacle within the shaft 16. The attachment of the head 18 to the shaft 16 is as described above in reference to FIG. 4. Optionally, the head 18 may include an access plug 102 that can be removed to facilitate cleaning the lowest portion 92 of the elongated sealed receptacle 62.

Figure 7:
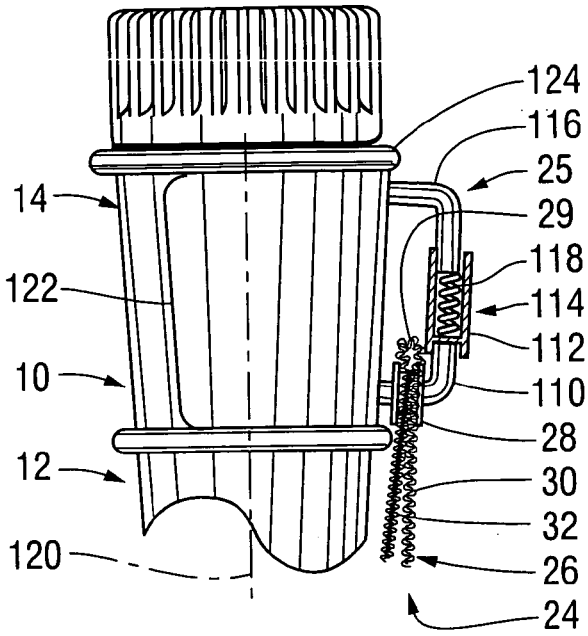
FIG. 7 is a partly sectional side elevation of an upper end of the urinal apparatus of FIG. 1.

FIG. 7 is a partly sectional side elevation of an upper end of the handle 14 of the urinal apparatus 10, showing the attachment device 25 removably attaching the privacy shield 24 to the handle 14 of the simulated golf club 12. As described above in reference to FIG. 1, the privacy shield 24 includes a folded towel 26 having an eyelet 28 attached close to the fold 29, allowing the front portion 30 of the towel 26 to be raised, while the rear portion 32 of the towel 26 continues to hang downward. The eyelet 28 extends through holes in both the front portion 30 and the rear portion 32 to hold the towel 26 in a folded condition. A hole 109 (shown in FIG. 1) in the eyelet 28 extends over a lower leg 110 of the attachment device 25, being held on the lower leg 110 by a sliding coupling member 112, occupying a space 114 between the lower leg 110 and an upper leg 116. The coupling member 112 is, in turn, held in place by an internal compression spring 118. The coupling member 112 is manually held upward to install the eyelet 28 over the lower leg 110 or to remove the eyelet 28 from the lower leg 110, so that the privacy shield 26 can be installed on the attachment device 25 or removed therefrom.

The attachment device 25 is preferably attached to the handle 14 in a manner allowing the angle of the attachment device 25 about the longitudinal axis 120 of the handle 14 to be adjusted by the user. In this way, the user is provided with a means to compensate for changes in the angle of the head 18 relative to the handle 14, with such changes occurring due to variations in the torque used to tighten the threads used to attach the shaft 16 of the simulated golf club 12 to the head 18 and to the handle 14, and with changes in the compression of one or more gaskets that may be provided to prevent leakage. For example, the legs 110, 116 of the attachment device 25 are attached to a curved spring member 122, extending around two-thirds of the circumference of the handle 14 to hold the attachment device 25 in place while allowing its rotation about the longitudinal axis 120. Ribs 124 within the handle 14 retain the curved spring member 122 while allowing its rotation about the longitudinal axis 120.

Figure 8:
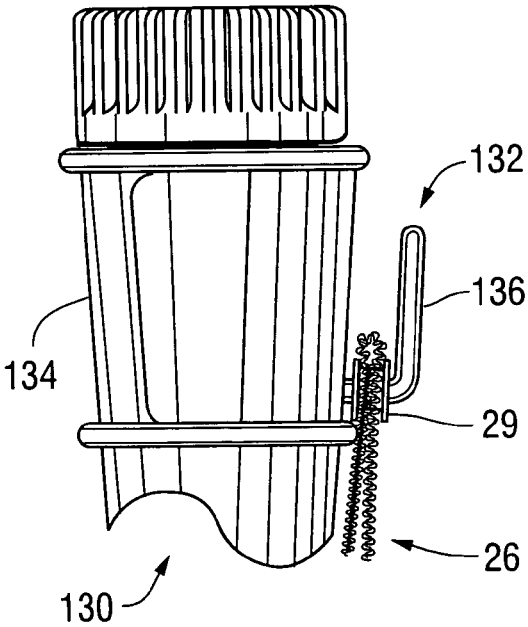
FIG. 8 is a partly sectional side elevation or an upper end of urinal apparatus having a first alternative device for attaching a privacy shield.

FIG. 8 is a partly sectional side elevation of urinal apparatus 130, which is similar to the urinal apparatus 10, described above in reference to FIG. 1, except that a first alternative attachment device 132 is provided for removably attaching the privacy shield 26 to a handle 134. The attachment device 132 comprises an upwardly directed leg 136, upon which the eyelet 29 of the privacy shield 26 is hung, allowing gravity to then hold the privacy shield 26 in place.

Figure 9:
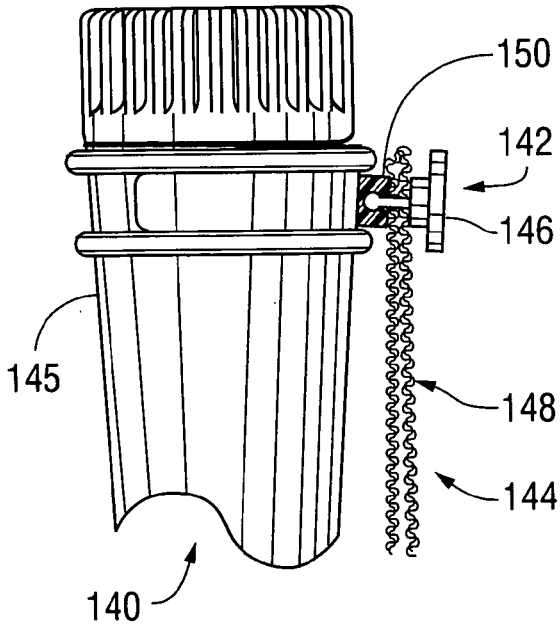
FIG. 9 is a partly sectional side elevation of an upper end of urinal apparatus having a second alternative device for attaching a privacy shield.

FIG. 9 is a partly sectional side elevation of urinal apparatus 140, which is again similar to the urinal apparatus 10, except that a second alternative attachment device 142 is provided for removably attaching an alternative privacy shield 144 to a handle 145. The alternative privacy shield 144 includes a snap 146 attached to a folded towel 148, while the attachment device 142 includes a receptacle 150 releasably holding the snap 146.

Figure 10:
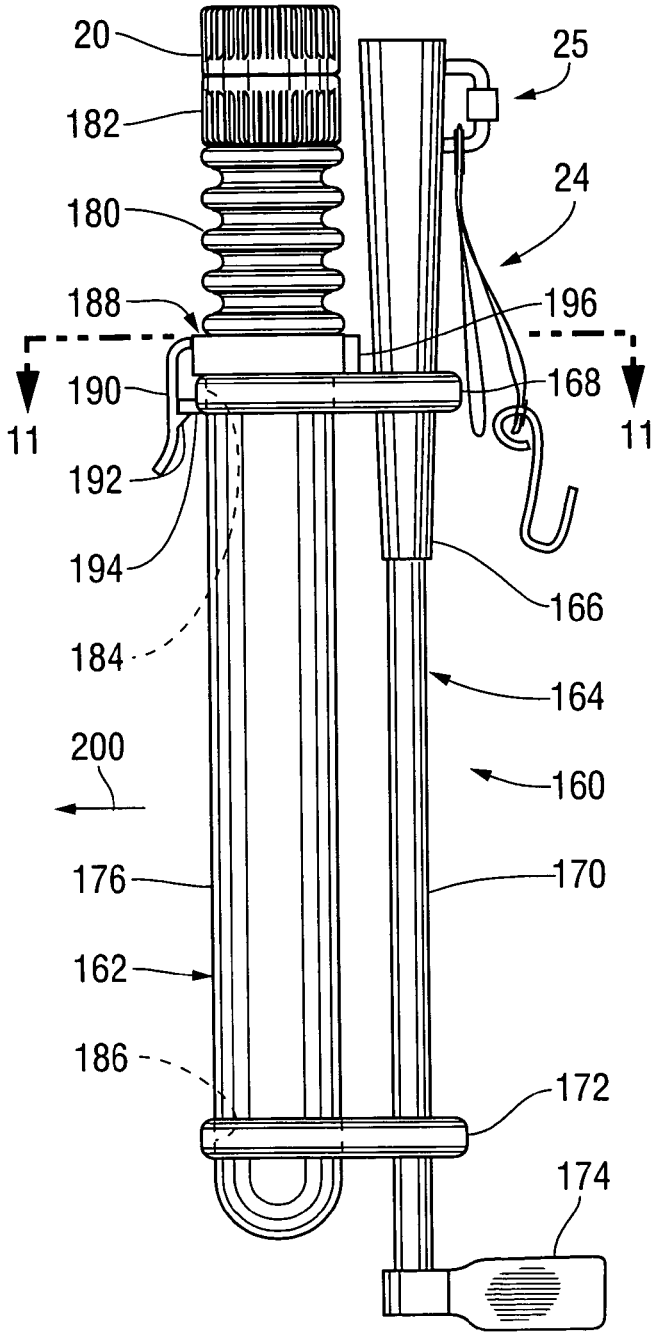
FIG. 10 is a side elevation of urinal apparatus built in accordance with a first version of a second embodiment of the invention.
Figure 11:
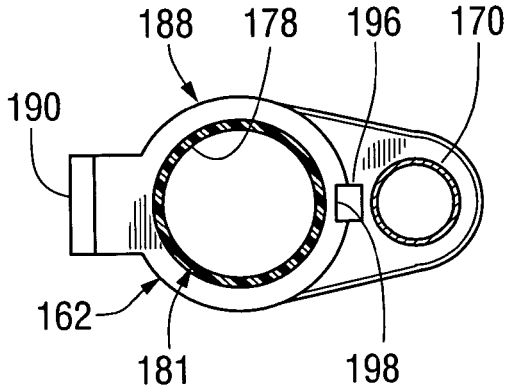
FIG. 11 is a cross-sectional plan view of the urinal apparatus of FIG. 10.

A second embodiment of the invention, in which the elongated sealed receptacle is formed within a canister in a urinal attachment separate from the simulated golf club, will now be discussed. FIGS. 10 and 11 show a first version 160 of urinal apparatus built in accordance with the second embodiment, with FIG. 10 being a side elevation thereof, and with FIG. 11 being a cross-sectional plan view thereof, taken as indicated by section lines 11-11 in FIG. 10. The urinal apparatus 160 thus includes a urinal attachment 162, which is separate from the simulated golf club 164, but which extends along the simulated golf club 164, being attached to a handle 166 of the simulated golf club 164 by an upper attachment bracket 168 and to a shaft 170 of the simulated golf club 164 by a lower attachment bracket 172. Both the attachment brackets 168, 172 are rigidly attached to the simulated golf club 164, which additionally includes a head 174. The urinal attachment 162 includes a canister 176, in which a cavity 178 is formed, a flexible neck 180, and a removable cap 20, which, being similar to the cap previously described in reference to FIG. 2, is included a like reference number. An elongated sealed receptacle 181 extends within the cavity 178 and within the flexible neck 180 to be sealed by the removable cap 20, which engages screw threads within an upper ring 182 of the urinal attachment 162 in a manner described above in reference to FIG. 2. The flexible neck 180 is formed as a hollow ribbed hose allowing the upper ring 182 to be moved by the user to a convenient angle for use.

The canister 176 extends through a hole 184 within the upper bracket 168 and through a hole 186 in the lower bracket 172, with an attachment ring 188 of the urinal attachment 162 resting on the upper bracket 168. The urinal attachment 162 is held in place on the simulated golf club 164 by a flexible latch 190, forming a portion of the attachment ring 188, having a latching tooth 192 disposed under an edge 194 of the upper bracket 168. The upper bracket 168 includes a key 196 that extends upward through a slot 198 in the attachment ring 188 to maintain alignment between the flexible latch 190 and the edge 194. The urinal attachment 162 may be removed for emptying and cleaning by pulling the flexible latch 190 in the outward direction of arrow 200, so that the latch 190 is disengaged from the edge 194, and by then lifting the attachment 162 to remove the canister 176 from the attachment brackets 168, 172. The urinal attachment 162 is subsequently reinstalled on the simulated golf club 164 by being pushed through the holes 184, 186 until the flexible latch 190 snaps into place, holding the attachment 162 as shown in FIG. 10.

The urinal apparatus 160 additionally includes a privacy shield 24 removably attached to the handle 166 by an attachment device 25. Since the privacy shield 24 and the attachment device 25 are, for example, as described above in reference to FIGS. 1 and 7, they are accorded like reference numbers.

Figure 12:
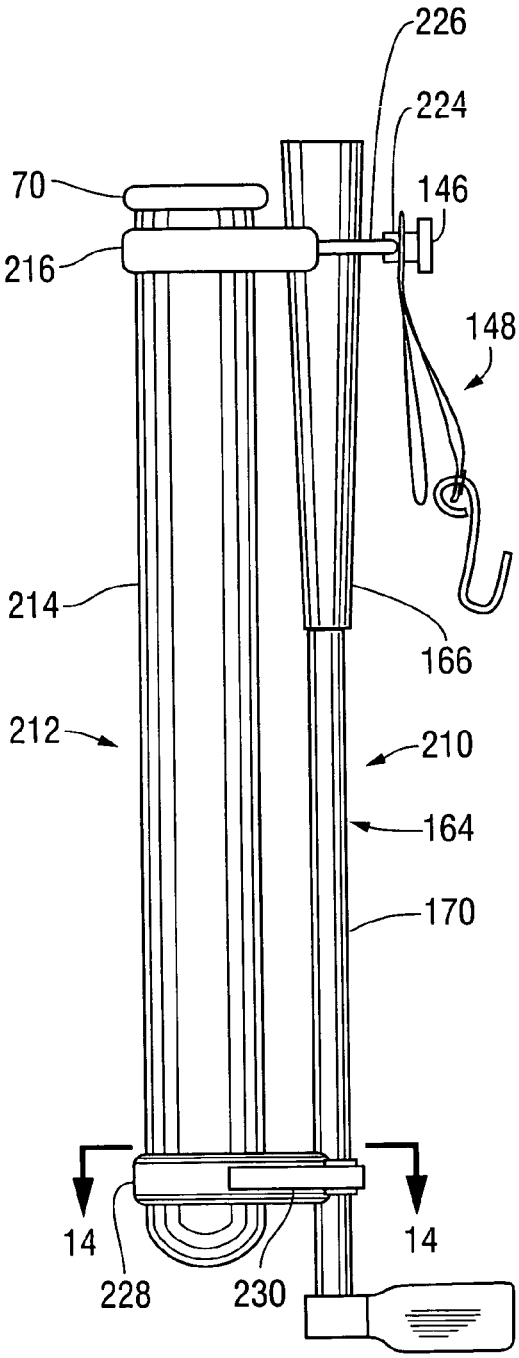
FIG. 12 is a side elevation of urinal apparatus built in accordance with a second version of the second embodiment of the invention.

FIG. 12 is a side elevation of a second version 210 of urinal apparatus built in accordance with the second embodiment of the invention to include a urinal attachment 212 and a simulated golf club 164, which, being similar to the simulated golf club described above in reference to FIGS. 10 and 11, Is accorded like reference numbers. The urinal attachment 212 includes a canister 214 and a plug 70, which being similar to the plug described above in reference to FIG. 3, is accorded a like reference number.

Figure 13:
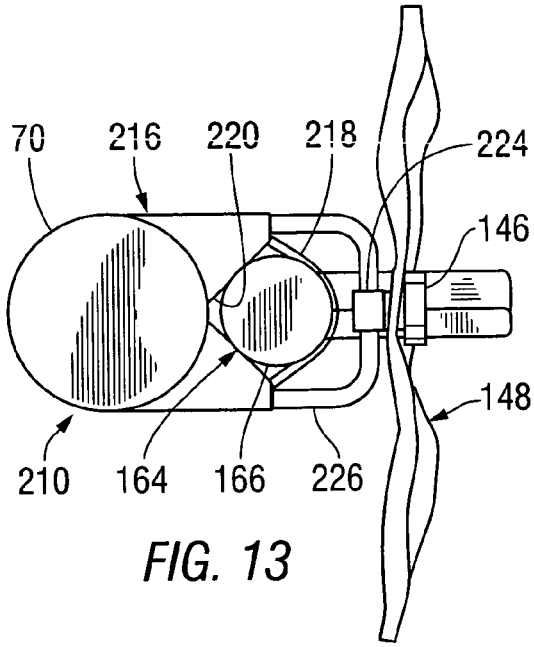
FIG. 13 is a plan view of the urinal apparatus of FIG. 12.

FIG. 13 is a plan view of the urinal apparatus 210, which is attached to the handle 166 of the simulated golf clul 164 by an upper bracket 216 including an elastic strap 211 holding the handle 166 against a concave surface 220 of the upper bracket 216. The upper bracket 216 is rigidly attached to the canister 214. The urinal apparatus 210 additionally includes a folded towel 148, as described above in reference to FIG. 9, having a snap 146 engaging a socket (not shown within a block 224 held by a support structure 226 extending from the upper bracket 216.

Figure 14:
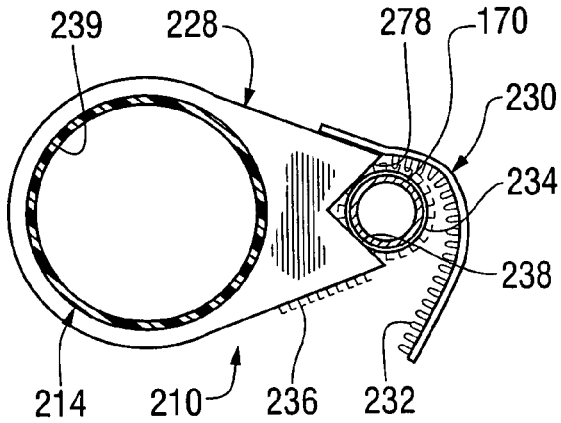
FIG. 14 is a cross-sectional plan view of the apparatus of FIG. 12, taken as indicated by section lines 14-14 therein.

FIG. 14 is a cross-sectional plan view of the urinal apparatus 210, taken as indicated by section lines 14-14 in FIG. 12 to show a lower bracket 228, attached to the canister 214 and used to fasten the canister 214 to the shaft 170 of the simulated golf club 164. A strap 230, attached to the lower bracket 228 and including an inward-facing first component 232 of a hook and loop fastener, is brought into engagement with an outward-facing second component of the hook and loop fastener. This second component of the hook and loop fastener is formed as a band 234 adhesively attached to the shaft 170 and as a patch 236 adhesively attached to the lower bracket 228. The components of the hook and loop fastener are brought together as the strap 230 is wrapped partly around the band 234 and pressed against the patch 236, so that the shaft 170, together with the surrounding band 234, is held within a concave surface 238 of the lower bracket 228. FIG. 14 additionally shows a sealed elongated reservoir 239, which extends within the canister 214, being sealed by the plug 70.

Figure 15:
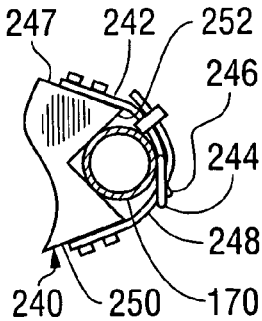
FIG. 15 is a fragmentary plan view of an alternate lower bracket for use within the urinal apparatus of FIG. 12.
Figure 16:
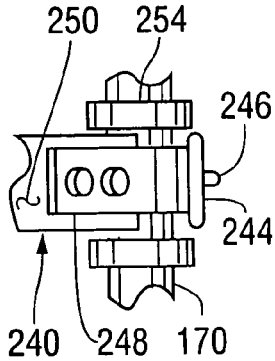
FIG. 16 is a fragmentary side elevation of the alternate lower bracket of FIG. 15.

FIGS. 15 and 16 show an alternate lower bracket 240 for use in place of the lower bracket 228, with FIG. 15 being a fragmentary, partly sectional plan view of the bracket 240 holding the shaft 170, and with FIG. 16 being a fragmentary side elevation thereof. A first strap 242, having a buckle 244 and a pin 246 pivoting with the buckle 244, is attached to a first side 247 of the alternate lower bracket 240, while a second strap 248, having a number of holes (not shown) in which the pin 246 may be engaged, is attached to a second side 250 of the bracket 240. When the straps 242, 244 are attached to one another as shown in the figures, the shaft 170 is held against a concave surface 252 of the bracket 240.

Preferably, a flange 254, adhesively attached to the shaft 170, are also provided adjacently above and adjacently below the bracket 240.

The simulated golf club 170 may be an actual golf club, which is converted into a simulated golf in the context of the invention by the attachment of the urinal attachment 212. The urinal attachment 212 may be provided without a golf club, for the user to attach to one of his golf clubs, with the band 234 or the flanges 254 being provided in the form of one or more flexible bands having an adhesive layer on one side for attachment to the shaft of a golf club and a surface engaging the second bracket 228 or its strap 230, 242, 248 on the other side.

Preferably, the elongated sealed reservoir 62, 239 has a capacity of at least 250 cubic centimeters.

It is understood that various features of the invention can be combined in ways not shown in the examples of the figures. For example, either the cap 20 or the plug 70 may be used with apparatus having other features shown. The flexible neck 180, which has been shown as a part of the second embodiment of the invention, may be formed as a part of the first embodiment.

While the invention has been described and shown in it preformed embodiments and versions, it is understood that this has been done only by way of example, and that various changes can be made without departing from the spirit and scope of the invention, as defined in the appended claims.

What is claimed is:

1. Urinal apparatus comprising:

a simulated golf club, resembling a golf club and including a handle, a shaft, and a head;

an elongated sealed receptacle, extending along the simulated golf club downward from an opening at a top of the elongated sealed receptacle, a removable cap sealing the opening at the top of the elongated sealed receptacle, and a privacy shield, disposed adjacent the opening at the top of the elongated sealed receptacle, wherein the privacy shield comprises a folded towel attached to the urinal apparatus near a fold within the folded towel and a hook attached to the folded towel near an edge of the towel.

2. Urinal apparatus comprising:

a simulated golf club, resembling a golf club and including a handle, a shaft, and a head;

an elongated sealed receptacle, extending along the simulated golf club downward from an opening at a top of the elongated sealed receptacle, within the handle, shaft, and head of the simulated golf club;

a removable cap, disposed at an upper end of the handle of the simulated golf club, sealing the opening at the top of the elongated sealed receptacle, and a privacy shield disposed adjacent the opening at the top of the elongated sealed receptacle, wherein the privacy shield forms a private space during urination into the opening at the top of the elongated sealed receptacle, wherein the privacy shield comprises a folded towel attached to the handle near a fold within the folded towel, wherein a front portion of the towel can be held upward to enlarge the space covered by the towel while a rear portion of the towel continues to hang downward, and wherein the privacy shield additionally comprises a hook attached to the folded towel near an edge of the towel.

* * * * *